US006299015B1

(12) United States Patent
Hasan et al.

(10) Patent No.: US 6,299,015 B1
(45) Date of Patent: Oct. 9, 2001

(54) CANDY DISPENSING APPARATUS

(75) Inventors: Syed Hasan, San Ramon, CA (US); Lawrence A. Blaustein, Moreland Hills, OH (US); Patrick W. Brown, Auburn, OH (US); Douglas Gall, Westlake, OH (US)

(73) Assignee: Oddzon Inc., Pawtucket, RI (US)

( * ) Notice: Subject to any disclaimer, the term of this patent is extended or adjusted under 35 U.S.C. 154(b) by 0 days.

(21) Appl. No.: 09/488,213

(22) Filed: Jan. 19, 2000

(51) Int. Cl.[7] ..... A24F 15/04
(52) U.S. Cl. ..... 221/24; 221/248
(58) Field of Search ..... 221/24, 155, 203, 221/247, 248, 290; 312/49, 35

(56) References Cited

U.S. PATENT DOCUMENTS

| | | | |
|---|---|---|---|
| 790,111 | 5/1905 | Crossley . | |
| 1,354,307 | 9/1920 | Joslin . | |
| 1,725,965 | 8/1929 | Ormiston . | |
| 1,887,389 | 11/1932 | Adams . | |
| 2,117,370 | 5/1938 | Sigg | 312/46 |
| 2,159,356 | 5/1939 | Lambert | 312/76 |
| 4,958,746 | 9/1990 | Wu | 221/24 |
| 4,976,376 | 12/1990 | Williams | 221/24 |
| 5,385,267 | 1/1995 | Diamond et al. | 221/248 |
| 5,651,475 | 7/1997 | Fenton | 221/24 |
| 5,673,813 | 10/1997 | Russell | 221/203 |

OTHER PUBLICATIONS

Cap Candy Catalog, pp. 10, 11, 16, 17, prior art.
U.S. Ser. No. 09/330,623 filed Jun. 11, 1999 naming Tom Prichard, Tsiu Ching Man and Ng Kwok Leung as inventors (copy not enclosed).
Taz Candy Hander sketch (prior art).
Wile E. Coyote Candy Hander sketch (prior art).

*Primary Examiner*—Kenneth Noland
(74) *Attorney, Agent, or Firm*—Marshall, Gerstein, & Borun

(57) ABSTRACT

A candy dispensing apparatus is provided with a housing having an opening formed therein, a reservoir disposed in the housing and shaped to hold a plurality of pieces of candy, and an animated figure having a hand that is shaped to hold a piece of candy. The animated figure is movable relative to the housing between a first position and a second position, and a dispensing mechanism disposed in the housing and operatively coupled to the animated figure. The hand of the animated figure is movable from a retracted position in which the hand is positioned within the housing to an extended position in which the hand extends out of the housing through the opening in the housing. The hand moves from the retracted position to the extended position upon the animated figure being moved from its first position to its second position. The dispensing mechanism is designed to cause a piece of candy to be transferred from the reservoir in the housing to the hand of the animated figure so that the piece of candy is supported by the hand when it is in the extended position.

24 Claims, 5 Drawing Sheets

CANDY DISPENSING APPARATUS

BACKGROUND OF THE INVENTION

The present invention is directed to a candy dispensing apparatus.

Various dispensing devices have been designed in the past to provide entertaining ways of dispensing pieces of candy or other articles. For example, U.S. Pat. No. 790,111 to Crossley discloses a match delivering device having a vertically movable human figure with a pair of outwardly extending arms and an internal storage area for storing matches. Pushing the human figure downwards causes one of the matches in the storage area to be ejected and held on the outwardly extending arms.

U.S. Pat. No. 2,159,356 to Lambert discloses a cigarette dispenser having a skeleton figure which moves from a laying position to a sitting-up position in which the skeleton figure holds a cigarette in a pair of bony hands.

U.S. Pat. No. 1,725,965 to Ormiston discloses a mechanism for dispensing globular articles such as gumballs. Referring to FIGS. 1 and 4 of the patent, the dispensing mechanism has a human FIG. 35 with an arm that holds a scoop 52 that is shaped to hold a single gumball. The human FIG. 35 is movable so that the scoop 52 moves to receive a single gumball from a plurality of gumballs stored in an area behind a pivotally mounted door 38. After a gumball is deposited in the scoop 52, the human FIG. 35 is movable to position the scoop 52 with the gumball therein over a dispensing trough 57 operatively connected to a delivery tray 137. The scoop 52 is then tilted so that the gumball falls in the dispensing trough 57 and then onto the delivery tray 137, at which point the gumball can be picked up.

One prior art candy dispensing mechanism which was marketed more than one year before the filing of this patent was an M&M® candy dispensing character. That dispensing character had a M&M® candy shaped body, a pair of boots which were attached to a bottom portion of the body, a pair of movable hands and arms that extended outwardly from body, and a cylindrical candy container filled with M&M® candies which mounted onto the body in an inverted position.

In use, after the candy container with the M&M® candies was mounted onto the body in its inverted position, the position of the left hand of the prior art candy dispensing character was manipulated to cause an M&M® candy to be dispensed from the candy container into the right hand of the candy dispensing character. In particular, in response to a user pivoting the left hand, the right hand of the candy dispensing character would be drawn into the body, an M&M® candy would be deposited into the right hand, and then the right hand would move outwardly with the M&M® candy disposed therein.

SUMMARY OF THE INVENTION

The invention is directed to a candy dispensing apparatus having a housing with an opening formed therein, a reservoir disposed in the housing and shaped to hold a plurality of pieces of candy, an animated figure having a hand that is shaped to hold a piece of candy, the animated figure being movable relative to the housing between a first position and a second position, and a dispensing mechanism disposed in the housing and operatively coupled to the animated figure.

The hand of the animated figure is movable from a retracted position in which the hand is positioned within the housing to an extended position in which the hand extends out of the housing through the opening in the housing. The hand moves from the retracted position to the extended position upon the animated figure being moved from its first position to its second position. The dispensing mechanism is designed to cause a piece of candy to be transferred from the reservoir in the housing to the hand of the animated figure so that the piece of candy is supported by the hand when it is in the extended position.

The animated figure may be provided with a body having a round shape resembling a piece of candy, a pair of eyes associated with the body, a mouth associated with the body, a pair of legs that extend from the body, a first arm associated with the body, a second arm associated with the body, and a second hand coupled to the second arm.

The dispensing mechanism may be adapted to cause a piece of candy to be transferred from the reservoir into the hand when the animated figure is moved from its second position to its first position. The dispensing mechanism may be provided with a dispensing hole formed in the housing and a rotatable member operatively coupled to the animated figure and disposed above the dispensing hole. The rotatable member may have a candy-transferring aperture formed therein that is shaped to transfer a piece of candy from the reservoir to a position above the dispensing hole so that the piece of candy falls through the dispensing hole into the hand of the animated figure.

The candy dispensing apparatus may also be provided with a base having a slot formed therein and a retaining member coupled to the animated figure, a portion of the retaining member passing through the slot in the base so as to control movement of the animated figure between its first and second positions.

The opening of the housing of the candy dispensing apparatus may be provided with a door that is movable between an open position and a closed position, and the hand of the animated figure may cause the door to move from its closed position to its open position when the hand moves from a concealed position within the housing to a revealed position outside of the housing.

The features and advantages of the present invention will be apparent to those of ordinary skill in the art in view of the detailed description of the preferred embodiment, which is made with reference to the drawings, a brief description of which is provided below.

DETAILED DESCRIPTION OF THE PREFERRED EMBODIMENTS

Figure 1:
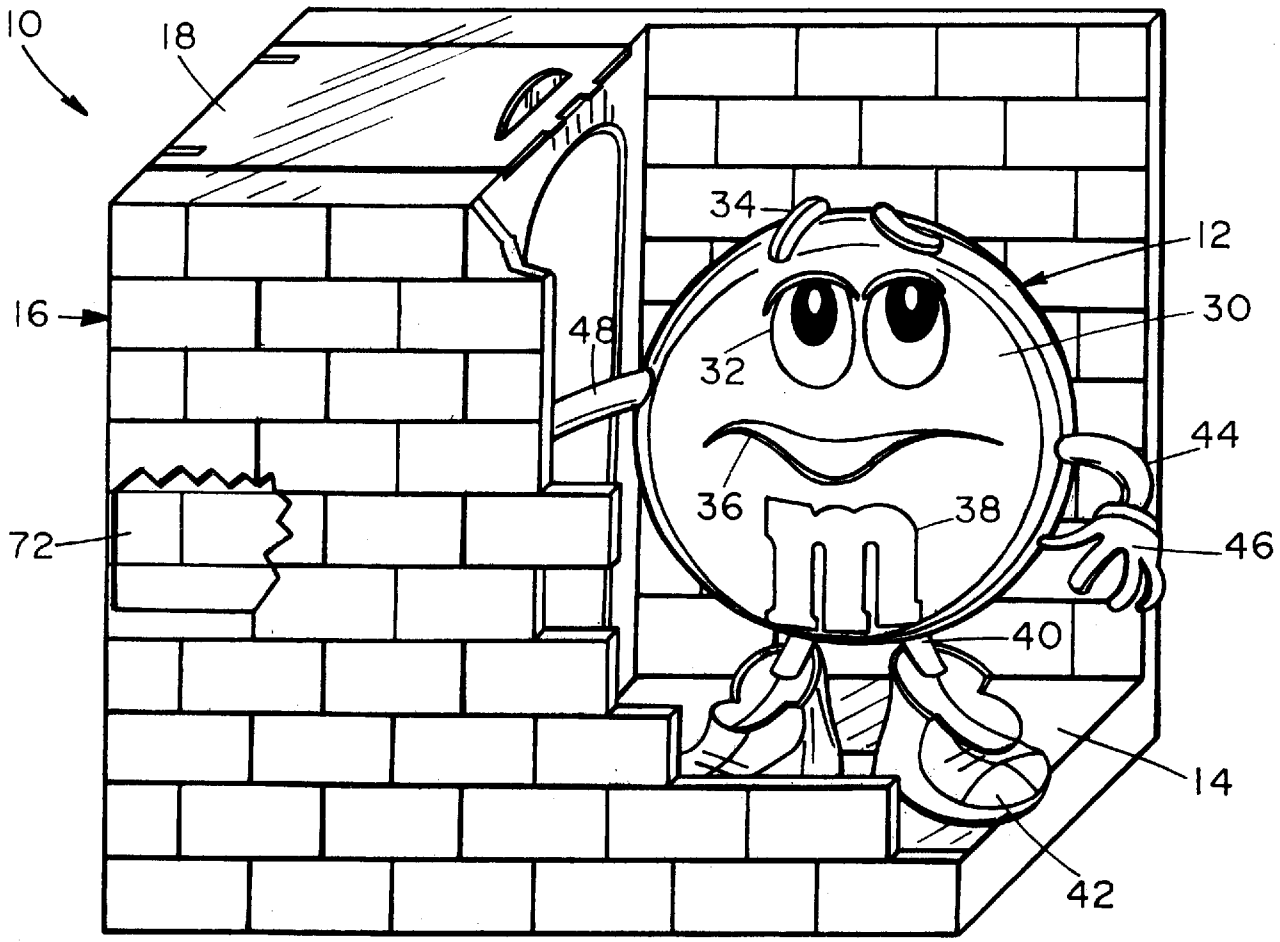
FIG. 1 is a perspective view of an embodiment of a candy dispensing apparatus in accordance with the invention with an animated figure in a first position.
Figure 5:
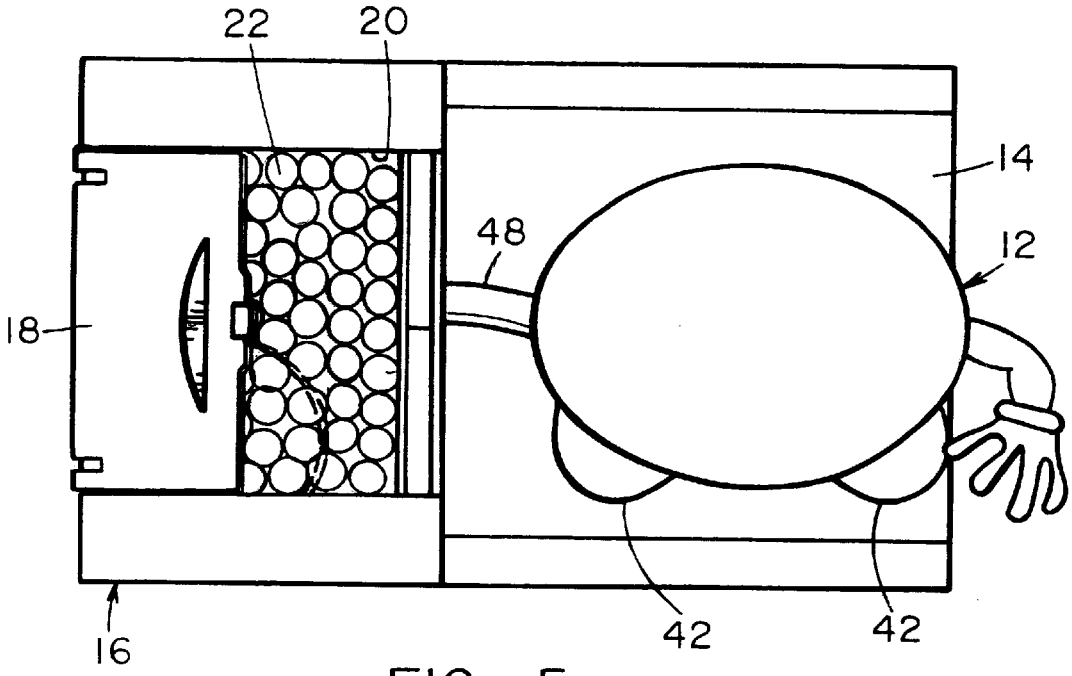
FIG. 5 is a top view of the candy dispensing apparatus with the animated figure in the first position and with a door shown in an open position.

FIG. 1 is a perspective view of an embodiment of a candy dispensing apparatus 10 in accordance with the invention. Referring to FIG. 1, the candy dispensing apparatus 10 has an animated FIG. 12, a base 14 over which the animated FIG. 12 is positioned, and a housing 16 disposed adjacent the animated FIG. 12. A supply door 18 is pivotally connected to the top of the housing 16 and, as shown in FIG. 5, encloses a candy reservoir 20 having a plurality of pieces of candy 22 disposed therein.

Figure 2:
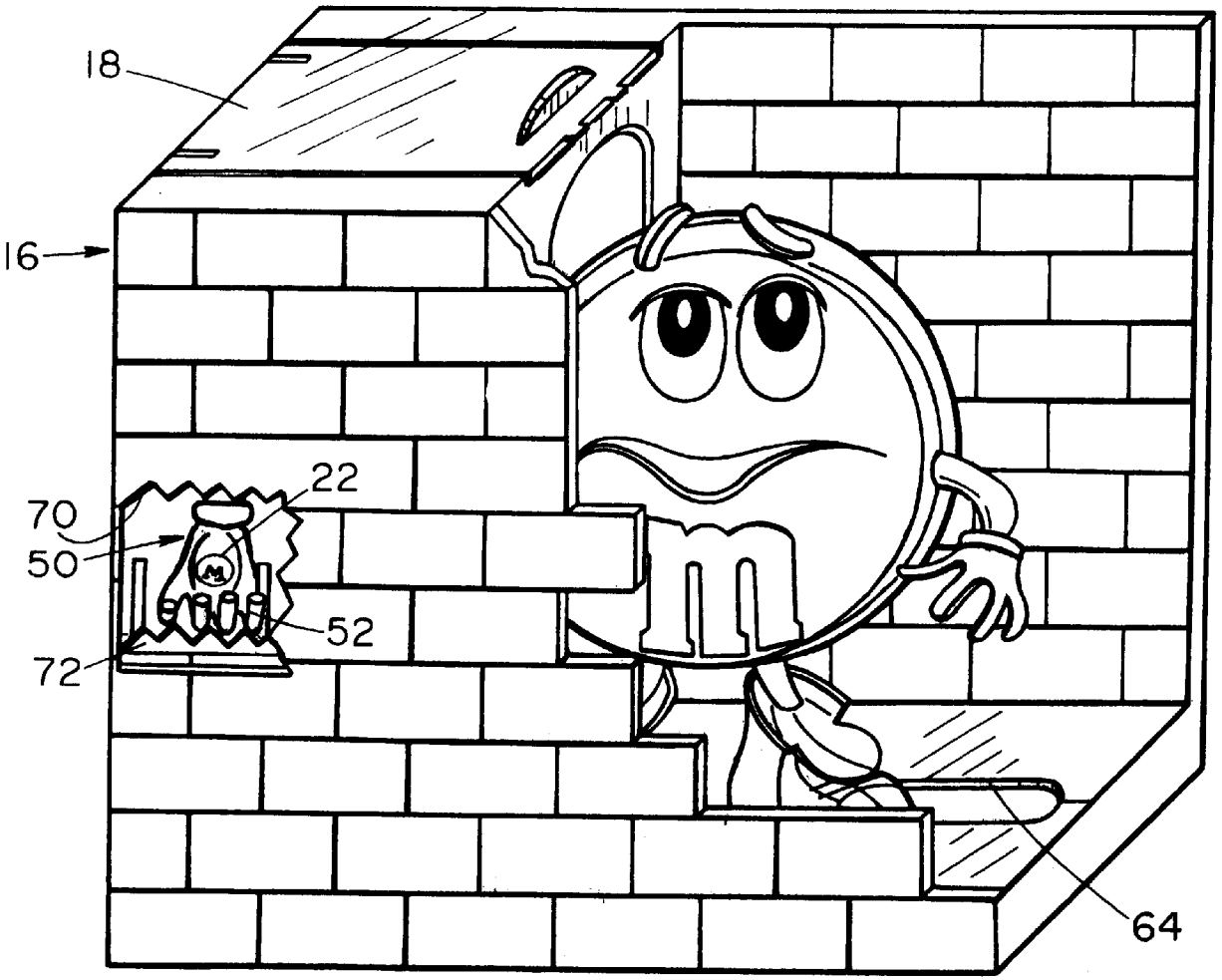
FIG. 2 is a perspective view of the candy dispensing apparatus of FIG. 1 with the animated figure in a second position.
Figure 6:
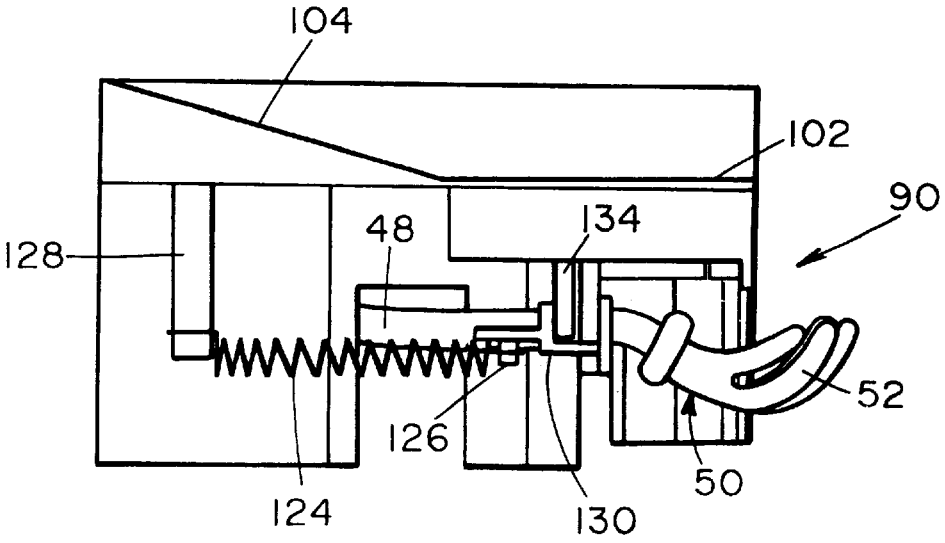
FIG. 6 is a side view of an interior portion of the candy dispensing apparatus.

The animated FIG. 12 may be provided with a body 30 with a round shape that resembles a piece of candy, such as an M&M® candy piece. The animated FIG. 12 may also be provided with a pair of eyes 32, a pair of eyebrows 34, a mouth 36, an indicia 38 such as the letter "m" representing a piece of candy, a pair of legs 40 and a pair of shoes or boots 42. The animated FIG. 12 may also have a left arm 44, a left hand 46, a right arm 48, and a right hand 50 (FIG. 2). As shown in FIGS. 2 and 6, the right hand 50 may have a plurality of fingers 52 which are upwardly curved so as to hold one (or more) of the pieces of candy 22.

Figure 4:
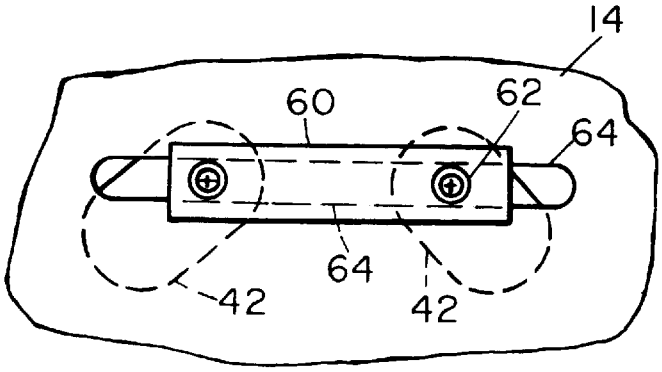
FIG. 4 is a bottom view of a portion of the candy dispensing apparatus.

The animated FIG. 12 is slidably supported on top of the base 14. As shown in FIG. 4, which is a bottom view of a portion of the base 14, the shoes 42 of the animated FIG. 12 are connected to a slide plate 60, such as by a plurality of screws 62 which pass through the slide plate 60 into the bottoms of the shoes 42, with the slide plate 60 being disposed below the base 14 and the shoes 42 being disposed above the base 14. The base 14 has a slot 64 formed therein, and the abutment of each of the screws 62 (or cylindrical housings (not shown) through which the screws 62 may pass) with one of the ends of the slot 64 defines the extent to which the animated FIG. 12 can be slid on the base 14.

Referring to FIGS. 1 and 2, the front of the housing 16 has an opening 70 formed therein, which may be an irregularly shaped opening, and a door 72 is associated with the opening 70. The door 72 is movable between an open position, shown in FIG. 2, in which the right hand 50 of the animated FIG. 12 extends through the opening 70, and a closed position, shown in FIG. 1, in which the door 72 closes the opening 70 and is flush with the front of the housing 16.

Figure 3:
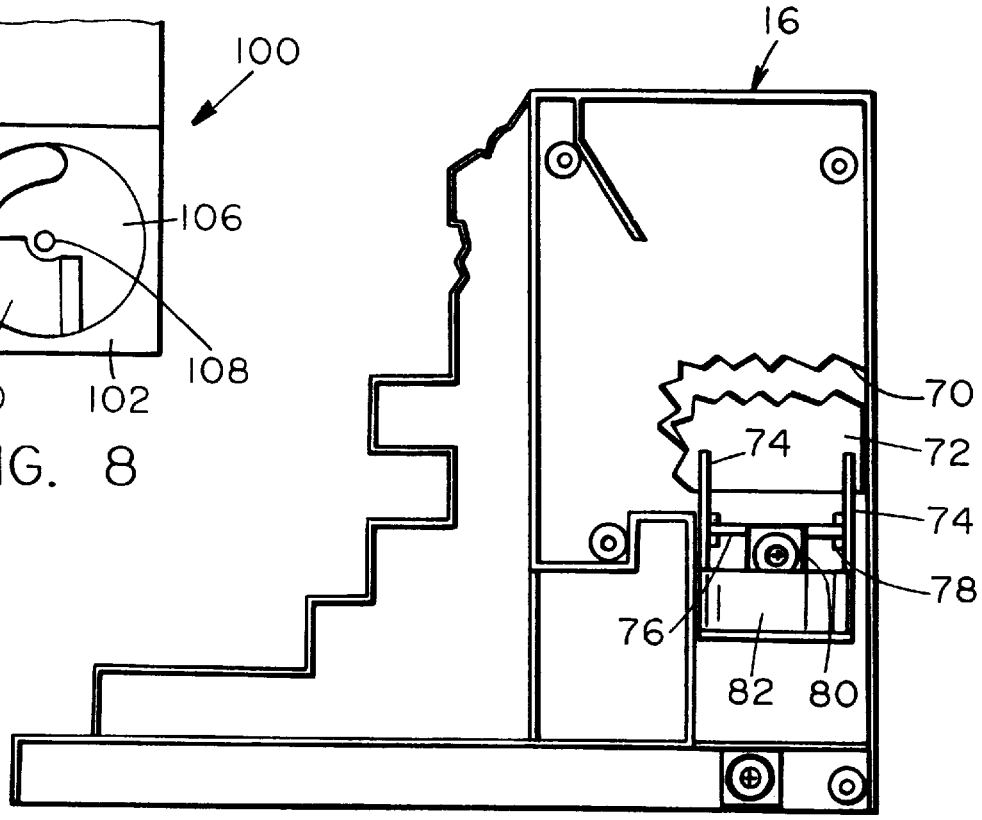
FIG. 3 is a rear view of a portion of the candy dispensing apparatus.

As shown in FIG. 3, which is a rear view of a portion of the housing 16, the door 72 has a pair of arms 74 integrally formed therewith or otherwise attached thereto. A cylindrical pivot rod 76 is connected to the arms 74 and pivotally supported by one or more generally U-shaped pivot clamps 78, and the pivot rod 76 may be held in place by a retaining member 80 threadably coupled to the housing 16. A counterweight 82 is also connected to the arms 74.

In the absence of a horizontal force directed against the back of the door 72, the downward force generated by the counterweight 82 holds the door 72 in a closed position flush with the exterior of the housing 16. However, when a horizontal force is applied to the back of the door 72, by the right hand 50 of the animated FIG. 12, for example, such force overcomes the weight of the counterweight 82 and moves the door 72 to an open position, as shown in FIG. 2.

Figure 8:
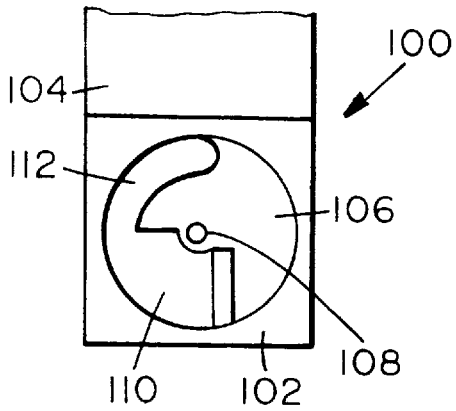
FIG. 8 is a top view of an interior portion of the housing of the candy dispensing apparatus.

Referring to FIGS. 6–8, a candy dispensing mechanism 90 is disposed within the housing 16. The dispensing mechanism 90 includes a rotatable member in the form of a turntable 92 that has a central pivot pin 94 about which the turntable 92 rotates. The turntable 92 is round and has a generally arcuate, candy-positioning slot or aperture 96 formed therein. The aperture 96 is large enough to accommodate at least one of the pieces of candy 22.

The turntable 92 is disposed on a support member or plate 100, shown in FIGS. 6 and 8, that forms a bottom portion of the candy reservoir 20. The support plate 100 has a generally horizontal plate surface 102 and a plate surface 104 that is angled downwardly towards the surface 102 so that the candy pieces 22 are urged, under the influence of gravity, towards the surface 102. The support plate 100 has a plate surface 106 that is recessed downwardly from the surface 102 to accommodate the turntable 92. The recessed plate surface 106 has a hole 108 formed therein to accommodate the pivot pin 94 of the turntable 92. The recessed plate surface 106 also has a candy dispensing hole or aperture 110 and an arcuate guide aperture 112 formed therein.

Figure 7A:
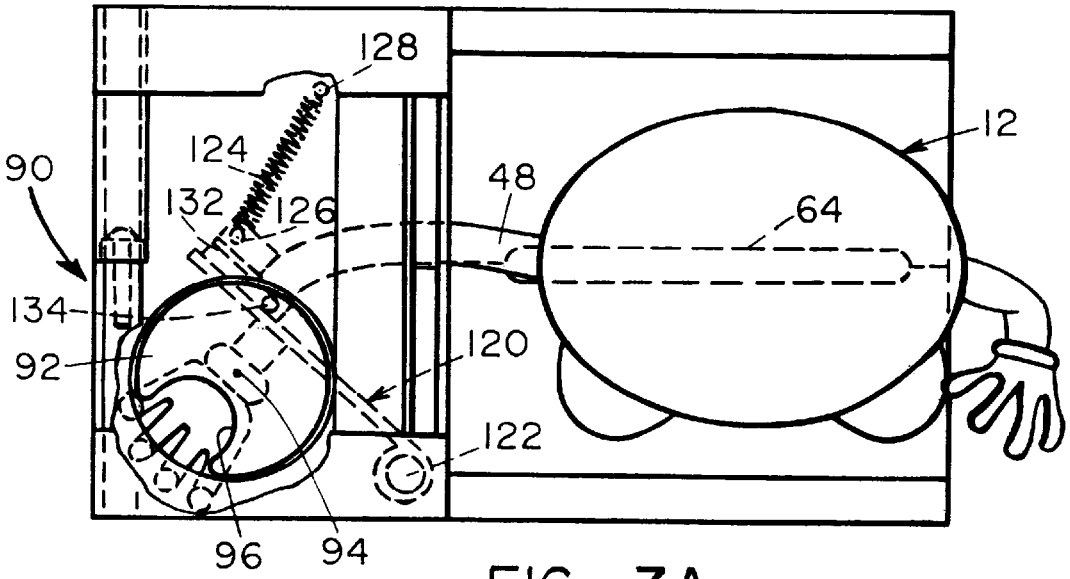
FIG. 7A is a top view of the candy dispensing apparatus with the animated figure in the first position.
Figure 7B:
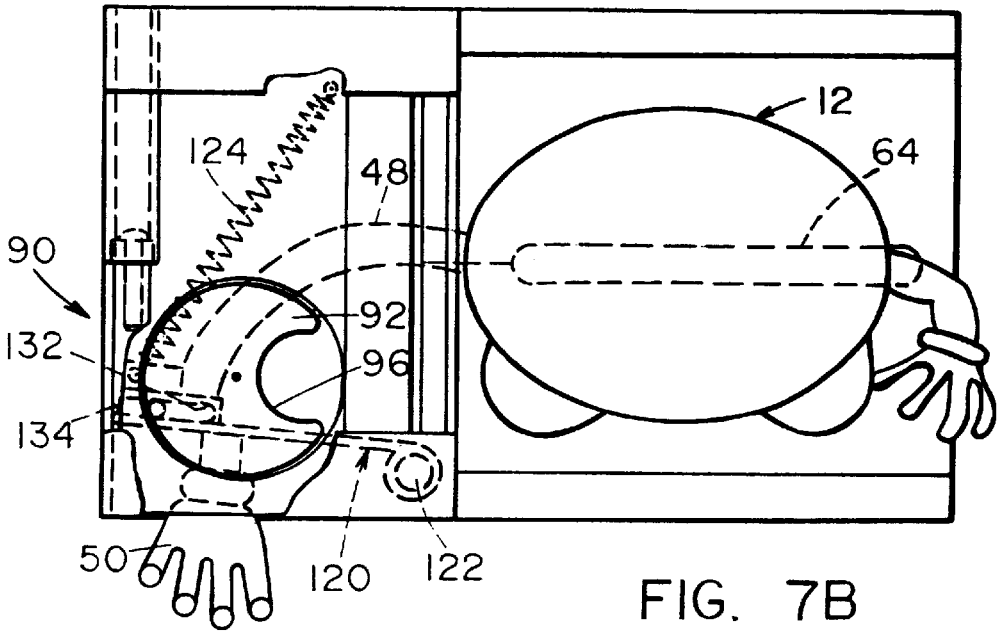
FIG. 7B is a top view of the candy dispensing apparatus with the animated figure in the second position.

Referring to FIGS. 6, 7A and 7B, the candy dispensing mechanism 90 has a pivot arm 120 that is connected to a pivot pin 122 for pivotal movement. The right arm 48 of the animated FIG. 12 is connected to the pivot arm 120, and the pivot arm 120 is spring-biased in a clockwise direction by a spring 124 connected to a spring post 126 fixed to the pivot arm 120 and a spring post 128 fixed to an interior portion of the housing 16. The right hand 50 of the animated FIG. 12 is attached to the distal end of the pivot arm 120. Since the right arm 48 is connected to the pivot arm 120, the right arm 48 need not be physically connected to the body 30 of the animated FIG. 12, but instead may be disposed merely adjacent the body 30 of the animated FIG. 12.

The distal end of the pivot arm 120 has a guide channel member 130 having a linear guide channel 132 formed therein. The bottom side of the turntable 92 has a positioning pin 134 fixed thereto, and the positioning pin 134 is positioned so that it extends downwardly from the turntable 92 into the guide channel 132 associated with the pivot arm 120.

Referring to FIG. 7A, the bias spring 124 causes the candy dispensing apparatus 10 to assume a normal position. In this position, the spring 124 exerts a force on the pivot arm 120 that urges the pivot arm 120 in a clockwise direction. Due to the attachment or coupling of the right arm 48 of the animated FIG. 12 to the pivot arm 120, the clockwise urging of the pivot arm 120 urges the right arm 48, and thus the animated FIG. 12, to the right in FIG. 7A, causing the animated FIG. 12 to be located at its rightmost position relative to the slot 64 along which the animated FIG. 12 slides.

When the dispensing apparatus 10 is in this normal position, the candy-positioning aperture 96 formed in the turntable 92 is disposed directly above the candy-dispensing aperture 110 (FIG. 8) in the support plate 100 and is also disposed directly above the right hand 50 of the animated FIG. 12. When in this position, the right hand 50 is in a concealed position within the housing 16 and the door 72 associated with the housing 16 is in its closed position, as shown in FIG. 1.

The candy dispensing apparatus 10 may be operated by manually pushing the animated FIG. 12 to the left, from its normal position shown in FIG. 7A to its position shown in FIG. 7B. Such leftward movement of the animated FIG. 12 will force the right arm 48 leftward, which causes the pivot arm 120 to pivot in a counterclockwise direction, against the force exerted by the bias spring 124.

Since the right hand 50 is fixed to the pivot arm 120, counterclockwise movement of the pivot arm 120 will force the right hand 50 to push against the back side of the door 72 in the housing 16, causing the door 72 to move, against the bias of its counterweight 82, from its closed position shown in FIG. 1 to its open position shown in FIG. 2. The right hand 50 will thus move from a retracted, concealed position (FIG. 1) within the housing 16 to an extended, revealed position (FIG. 2) outside the housing 16, in which the right hand 50 holds one (or more) of the candy pieces 22.

Counterclockwise movement of the pivot arm 120 will also cause rotation of the turntable 92. In particular, since the positioning pin 134 fixed to the underside of the turntable 92 is disposed within the guide channel 132 coupled to the pivot arm 120, the counterclockwise movement of the guide channel 132 will force the turntable 92 to rotate in a counterclockwise direction, from its position shown in FIG. 7A to its position shown in FIG. 7B. The arcuate slot 112 (FIG. 8) formed in the support plate 100 accommodates the arcuate movement of the positioning pin 134 of the turntable 92.

After the user takes the candy piece 22 from the extended right hand 50 of the animated FIG. 12 and releases the animated FIG. 12, the animated FIG. 12 is urged by the bias spring 124 from its position shown in FIG. 7B back to its normal position shown in FIG. 7A. During such movement of the animated FIG. 12, the pivot arm 120 will pivot in a clockwise direction, causing the right hand 50 to be retracted back into the housing 16 and allowing the door 72 to close under the influence of gravity.

Clockwise movement of the pivot arm 120 will also cause the turntable 92 to rotate in a clockwise direction, from its position shown in FIG. 7B to its position shown in FIG. 7A. During such movement, the candy-positioning slot 96 formed in the turntable 92 will move one (or more) of the candy pieces 22 to a position directly above the candy-dispensing aperture 110 formed in the support plate 100, so that the candy piece 22 falls through the aperture 110 into the right hand 50 of the animated FIG. 12.

Thus, repeated right and left movement of the animated FIG. 12 will repeatedly cause the right hand 50 of the animated FIG. 12 to extend outwardly from the housing 16, holding a new candy piece 22 each time.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A candy dispensing apparatus, comprising:

a housing having an opening formed therein;

a door associated with said opening in said housing, said door being movable between an open position and a closed position;

a reservoir disposed in said housing;

a plurality of pieces of candy disposed in said reservoir;

an animated figure associated with said housing, said animated figure comprising:

a body having a round shape resembling a piece of candy;

a pair of eyes associated with said body;

a mouth associated with said body;

a pair of legs that extend from said body;

a first arm associated with said body;

a second arm associated with said body;

a first hand coupled to said first arm, said first hand being shaped to hold a piece of candy; and a second hand coupled to said second arm, said animated figure being slidable relative to said housing between a first position and a second position, said first hand of said animated figure moving from a concealed position in which said first hand is positioned within said housing and not visible to a revealed position in which said first hand extends through said opening in said housing, said first hand being moved from said concealed position to said revealed position upon said animated figure being slid from said first position to said second position, said first hand of said animated figure causing said door in said housing to move from said closed position to said open position upon said animated figure being slid from said first position to said second position; and a dispensing mechanism disposed in said housing and operatively coupled to said animated figure, said dispensing mechanism causing one of said pieces of candy to be transferred from said reservoir in said housing to said first hand so that said one piece of candy is supported by said first hand when said first hand is in said revealed position.

2. An apparatus as defined in claim 1 wherein said dispensing mechanism causes one of said pieces of candy to be transferred from said reservoir into said first hand when said animated figure is moved from said second position to said first position.

3. An apparatus as defined in claim 1 wherein said dispensing mechanism comprises:

a dispensing hole formed in said housing; and a rotatable member operatively coupled to said first arm and disposed above said dispensing hole, said rotatable member having a candy-transferring aperture formed therein, said candy-transferring aperture being shaped to transfer one of said pieces of candy from said reservoir to a position above said dispensing hole so that said one piece of candy falls through said dispensing hole into said first hand of said animated figure.

4. An apparatus as defined in claim 3 additionally comprising a coupling member operatively coupled between said rotatable member and said first arm, said coupling member causing said rotatable member to rotate upon movement of said first arm.

5. An apparatus as defined in claim 1 additionally comprising a bias spring coupled to said housing and to said animated figure, said bias spring biasing said animated figure to said first position.

6. An apparatus as defined in claim 1 additionally comprising a supply door associated with said housing and said reservoir, said supply door being movable between an open position in which additional pieces of candy can be added to said reservoir and a closed position.

7. An apparatus as defined in claim 1 additionally comprising a pivot arm that pivotally connects said first arm to said housing.

8. An apparatus as defined in claim 1 additionally comprising:

a base associated with said housing, said base having a slot formed therein; and a retaining member coupled to said animated figure, a portion of said retaining member passing through said slot in said base so as to control sliding of said animated figure between said first and second positions.

9. A candy dispensing apparatus, comprising:

a housing having an opening formed therein;

a door associated with said opening in said housing, said door being movable between an open position and a closed position;

a reservoir disposed in said housing and shaped to hold a plurality of pieces of candy;

an animated figure associated with said housing, said animated figure having a hand that is shaped to hold a piece of candy, said animated figure being movable relative to said housing between a first position and a second position, said hand of said animated figure moving from a concealed position in which said hand is positioned within said housing and not visible to a revealed position in which said hand extends through said opening in said housing, said hand being moved from said concealed position to said revealed position upon said animated figure being moved from said first position to said second position, said hand of said animated figure causing said door in said housing to move from said closed position to said open position upon said animated figure being slid from said first position to said second position; and a dispensing mechanism disposed in said housing and operatively coupled to said animated figure, said dispensing mechanism being designed to cause a piece of candy to be transferred from said reservoir in said housing to said hand so that said piece of candy is supported by said hand when said hand is in said revealed position.

10. An apparatus as defined in claim 9 wherein said animated figure comprises:

a body having a round shape resembling a piece of candy;

a pair of eyes associated with said body;

a mouth associated with said body;

a pair of legs that extend from said body;

a first arm associated with said body, said hand being coupled to said first arm;

a second arm associated with said body; and a second hand coupled to said second arm.

11. An apparatus as defined in claim 9 wherein said dispensing mechanism is adapted to cause a piece of candy to be transferred from said reservoir into said hand when said animated figure is moved from said second position to said first position.

12. An apparatus as defined in claim 9 wherein said dispensing mechanism comprises:

a dispensing hole formed in said housing; and a rotatable member operatively coupled to said animated figure and disposed above said dispensing hole, said rotatable member having a candy-transferring aperture formed therein, said candy-transferring aperture being shaped to transfer a piece of candy from said reservoir to a position above said dispensing hole so that said piece of candy falls through said dispensing hole into said hand of said animated figure.

13. An apparatus as defined in claim 12 additionally comprising a coupling member operatively coupled between said rotatable member and said animated figure, said coupling member causing said rotatable member to rotate upon movement of said animated figure.

14. An apparatus as defined in claim 9 additionally comprising a bias spring coupled to said housing and to said animated figure, said bias spring biasing said animated figure to said first position.

15. An apparatus as defined in claim 9 additionally comprising:

a base associated with said housing, said base having a slot formed therein; and a retaining member coupled to said animated figure, a portion of said retaining member passing through said slot in said base so as to control movement of said animated figure between said first and second positions.

16. A candy dispensing apparatus, comprising:

a housing having an opening formed therein;

a reservoir disposed in said housing and shaped to hold a plurality of pieces of candy;

an animated figure associated with said housing, said animated figure having a hand that is shaped to hold a piece of candy, said animated figure being movable relative to said housing between a first position and a second position, said hand of said animated figure moving from a retracted position in which said hand is positioned within said housing to an extended position in which said hand extends out of said housing through said opening in said housing, said hand being moved from said retracted position to said extended position upon said animated figure being moved from said first position to said second position; and a dispensing mechanism disposed in said housing and operatively coupled to said animated figure, said dispensing mechanism being designed to cause a piece of candy to be transferred from said reservoir in said housing to said hand so that said piece of candy is supported by said hand when said hand is in said extended position.

17. An apparatus as defined in claim 16 wherein said animated figure comprises:

a body having a round shape resembling a piece of candy;

a pair of eyes associated with said body;

a mouth associated with said body;

a pair of legs that extend from said body;

a first arm associated with said body, said hand being coupled to said first arm;

a second arm associated with said body; and a second hand coupled to said second arm.

18. An apparatus as defined in claim 16 wherein said dispensing mechanism is adapted to cause a piece of candy to be transferred from said reservoir into said hand when said animated figure is moved from said second position to said first position.

19. An apparatus as defined in claim 16 wherein said dispensing mechanism comprises:

a dispensing hole formed in said housing; and a rotatable member operatively coupled to said animated figure and disposed above said dispensing hole, said rotatable member having a candy-transferring aperture formed therein, said candy-transferring aperture being shaped to transfer a piece of candy from said reservoir to a position above said dispensing hole so that said piece of candy falls through said dispensing hole into said hand of said animated figure.

20. An apparatus as defined in claim 16 additionally comprising:

a base associated with said housing, said base having a slot formed therein; and a retaining member coupled to said animated figure, a portion of said retaining member passing through said slot in said base so as to control movement of said animated figure between said first and second positions.

21. A candy dispensing apparatus, comprising:

a housing having an opening formed therein;

a reservoir disposed in said housing and shaped to hold a plurality of pieces of candy;

an animated figure associated with said housing, said animated figure having a candy-holding member that is shaped to hold a piece of candy, said animated figure being movable relative to said housing between a first position and a second position, said candy-holding member of said animated figure moving from a retracted position in which said candy-holding member is positioned within said housing to an extended position in which said candy-holding member extends out of said housing through said opening in said housing, said candy-holding member being moved from said retracted position to said extended position upon said animated figure being moved from said first position to said second position; and a dispensing mechanism disposed in said housing and operatively coupled to said animated figure, said dispensing mechanism being designed to cause a piece of candy to be transferred from said reservoir in said housing to said candy-holding member so that said piece of candy is supported by said candy holding member when said candy-holding member is in said extended position.

22. An apparatus as defined in claim 21 wherein said dispensing mechanism is adapted to cause a piece of candy to be transferred from said reservoir into said candy-holding member when said animated figure is moved from said second position to said first position.

23. A candy dispensing apparatus, comprising:

a housing having an opening formed therein;

a reservoir disposed in said housing and shaped to hold a plurality of pieces of candy;

an animated figure associated with said housing, said animated figure having a candy-holding member that is shaped to hold a piece of candy, said animated figure being movable relative to said housing between a first position and a second position, said first position being spaced a first distance from said housing and said second position being spaced a second distance from said housing, said first distance being greater than said second distance, said candy-holding member of said animated figure moving from a retracted position to an extended position upon said animated figure being moved from said first position to said second position; and a dispensing mechanism disposed in said housing and operatively coupled to said animated figure, said dispensing mechanism being designed to cause a piece of candy to be transferred from said reservoir in said housing to said candy-holding member so that said piece of candy is supported by said candy holding member when said candy-holding member is in said extended position.

24. An apparatus as defined in claim 23 wherein said dispensing mechanism is adapted to cause a piece of candy to be transferred from said reservoir into said candy-holding member when said animated figure is moved from said second position to said first position.

* * * * *